US005180060A

United States Patent [19]

Forti et al.

[11] Patent Number: 5,180,060

[45] Date of Patent: Jan. 19, 1993

[54] INFLATABLE, ENCAPSULATING PACKAGING INSERT

[75] Inventors: Ernesto R. Forti, Barrington; Judith A. Jarvis, Medinah, both of Ill.

[73] Assignee: Jarvis Chemicals & Paper Company, Addison, Ill.

[21] Appl. No.: 728,231

[22] Filed: Jul. 10, 1991

[51] Int. Cl.[5] ..... B65D 81/02

[52] U.S. Cl. ..... 206/522; 383/3

[58] Field of Search ..... 206/522, 591, 525, 585, 206/593; 383/3

[56] References Cited

U.S. PATENT DOCUMENTS

| | | | |
|---|---|---|---|
| 2,907,580 | 10/1959 | Tietig . | |
| 3,072,270 | 1/1963 | Tolby et al. . | |
| 3,346,101 | 10/1967 | Pestka . | |
| 3,818,962 | 6/1974 | Muller-Scherak | 383/3 |
| 3,889,743 | 6/1975 | Presnick | 206/522 X |
| 3,949,879 | 4/1976 | Peterson et al. . | |
| 4,116,344 | 9/1978 | Ziemba . | |
| 4,465,188 | 8/1984 | Soroka et al. | 383/3 X |
| 4,468,810 | 8/1984 | Longo | 383/3 |
| 4,489,833 | 12/1984 | Bauer | 383/3 X |
| 4,551,379 | 11/1985 | Kerr . | |
| 4,569,082 | 2/1986 | Ainsworth et al. | 206/522 X |
| 4,573,202 | 2/1986 | Lee | 206/522 X |
| 4,874,093 | 10/1989 | Pharo . | |
| 4,905,835 | 3/1990 | Pivert et al. | 206/522 |
| 4,997,087 | 3/1991 | Lorenz | 206/591 X |
| 5,042,663 | 8/1991 | Heinrich | 206/522 |

*Primary Examiner*—Paul T. Sewell
*Assistant Examiner*—Jacob K. Ackun, Jr.
*Attorney, Agent, or Firm*—Emrich & Dithmar

[57] ABSTRACT

An inflatable packaging insert as adapted for positioning around and encapsulating an article disposed in a closed box when inflated for providing support and protection for the article during shipping. The packaging insert includes a pair of spaced, opposed V-shaped or triangular inserts forming a gusset on its inner surface allowing the packaging insert when inflated to securely engage the corners and edges of the article. The gusset allows the inner article-engaging surface of the packaging insert to expand as a generally flat surface so that it engages the entire facing surface of the object including its edges and corners in a generally uniform manner. The packaging insert is preferably comprised of a strong, pliable, gas-impervious material such as polyethylene and includes an integral self-sealing valve for inflation and deflation as well as interconnected compartments or chambers formed by heat, pressure or radio frequency (RF) formed seals. The packaging insert may assume various forms such as: a unitary, six section arrangement for lining a closed box; a pair of complementary multi-section inserts also adapted for lining the inside of a closed six-sided container; or an elongated, linear arrangement adapted for wrapping around the sides of an object and maintained in tight-fitting engagement therewith by means of a cinch-type locking feature integral with the inflatable member.

29 Claims, 5 Drawing Sheets

INFLATABLE, ENCAPSULATING PACKAGING INSERT

FIELD OF THE INVENTION

The present invention relates generally to packaging materials and arrangements for the shipment and storage of goods and is particularly directed to an inflatable packaging arrangement for encapsulating and tightly engaging an article and providing protection and support therefor.

BACKGROUND OF THE INVENTION

Delicate articles are typically enclosed in a protective cushioning material when transported in a closed container such as a cardboard box. The protective material isolates the article from large forces and shocks which may occur due to rough handling of the shipping container. The protective material may take the form of crumpled newspaper, styrofoam beads, popcorn, and, in some cases, end caps positioned on opposed ends of the article such as an appliance or television receiver. The end caps are typically comprised of an expanded polystyrene and are sized to snugly fit in the closed container.

Trapped air is also used to isolate the article from rough handling. Early efforts in this area made use of a sheet-formed plastic material of two sheets of thin, pliable plastic, sealed together with a plurality of pockets of air or bubbles formed therein. This arrangement, commonly referred to as a "bubble pak", tends to transfer any load imposed on the bubble to the article and is also subject to bursting of a bubble as the bubble is deformed with a substantial increase in pressure. Other trapped air packaging inserts are inflatable and are better capable of absorbing shock. Examples of inflatable packaging inserts can be found in U.S. Pat. Nos. 3,346,101 to Pestka, 3,949,879 to Peterson et al., 4,551,379 to Kerr, 4,905,835 to Pivert et al., and 4,874,093 to Pharo.

These inflatable packaging inserts typically include a plurality of interconnected chambers and a valve arrangement permitting the inflation and deflation of the packaging insert. The packaging insert further typically includes a pair of spaced sheets attached in a sealed manner at selective locations to form the aforementioned inflatable chambers. Upon inflation, each individual chamber experiences greatest expansion along points generally midway between its end portions. This can be seen in the patent to Pivert (FIGS. 2*a*–3*b*), Kerr (FIGS. 2 and 15–17), and Peterson (FIGS. 1 and 2). Inflatable packaging inserts of this type leave the edges and corners of an article with less protection than the inner surface portions of the article. In addition, because the article is not firmly engaged along its edges and adjacent to its corners, the article is not securely and firmly maintained in position and is subject to displacement and jarring when the container is dropped on one of its edges or corners. Moreover, in order to firmly maintain the article in position along three orthogonal axes, prior art inflatable packaging inserts require completely enclosing the article and securely engaging the side portions of the outer surfaces of the article. Finally, these prior art approaches are undesirable environmentally in that they occupy large volumes such as in a landfill following disposal once no longer useable.

The present invention overcomes the aforementioned limitations of prior art inflatable packaging inserts by providing an inflatable, encapsulating package insert or liner which securely engages and supports the edges and corners of an article disposed within the insert and positioned within a closed package. The article engaging inner surface of the inflatable packaging insert not only provides increased protection, but also secure support for the article during shipping.

OBJECTS AND SUMMARY OF THE INVENTION

Accordingly, it is an object of the present invention to provide improved packaging protection for an object in storage or transport.

Another object of the present invention is to provide an inflatable packaging insert which engages the outer surfaces of an object including its edges and corners in a substantially uniform manner.

Yet another object of the present invention is to provide an inexpensive, reusable inflatable packaging material having an integral valve and which can be inflated and deflated using conventional, readily available means.

A further object of the present invention is to provide a compartmentalized box liner adapted to take the shape of the article enclosed as well as the inner surface of the shipping container.

A still further object of the present invention is to provide a multi-section, inflatable liner of fixed dimensions for a shipping container adapted for wrapping around an object in the container in a secure, tight-fitting manner, where the size and configuration of the object may vary over a wide range of dimensions and may assume virtually any shape.

Still another object of the present invention is to provide an inflatable container liner adapted for encapsulating, supporting and immobilizing an article within the container regardless of the article's size and shape.

Another object of the present invention is to provide a packaging material which occupies minimum space when disposed of following its useful life.

This invention contemplates an inflatable packaging insert for protecting an article within an enclosed container, the packaging insert comprising: a first outer sheet and a second inner sheet each comprised of a flexible, gas-impervious material, wherein the first outer sheet is in contact with an inner surface of the container and the second inner sheet is disposed about and in contact with the article; a plurality of seals for coupling the first and second sheets in a sealed manner to form a plurality of interconnected inflatable chambers; and a valve for inflating the packaging insert, wherein the second inner sheet includes a gusset for allowing the second inner sheet to assume a generally planar shape during inflation of the packaging insert and to securely engage and encapsulate the corners and edges of the article.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION

Figure 1:
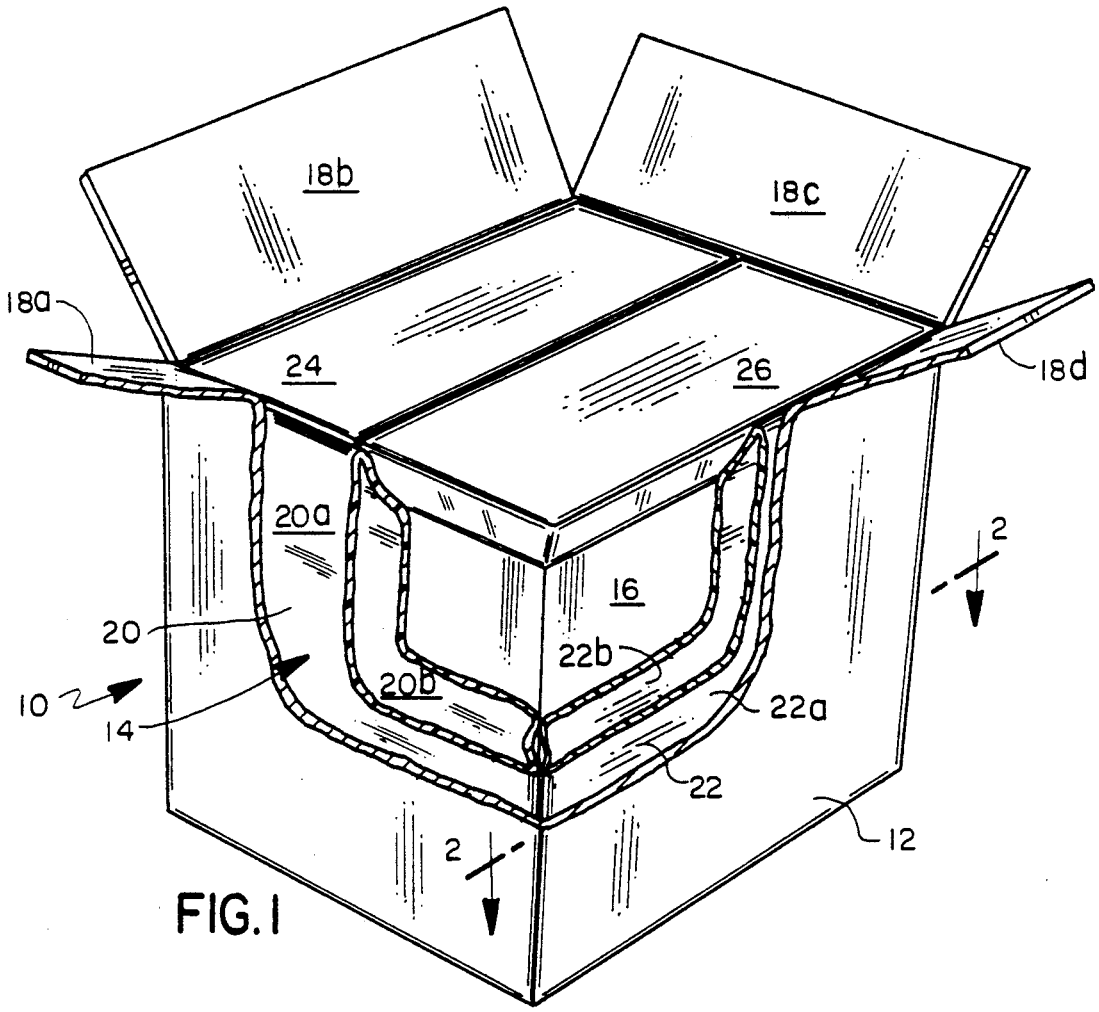
FIG. 1 is a partially cut-away perspective view of a packaging arrangement including an outer box or container and an inner package liner disposed about and engaging an article for shipment or storage in accordance with the present invention.

Referring to FIG. 1, there is shown a partially cut-away perspective view of a first packaging arrangement 10 in accordance with one embodiment of the present invention. The packaging arrangement 10 includes a box-like container 12 comprised of a conventional material such as cardboard. Disposed within the box-like container 12 is an inflatable, encapsulating package liner 14 which is adapted for positioning about and engaging an article or product 16. Article 16 may be virtually any type of product although the inflatable package liner 14 is particularly adapted for protecting fragile electronics instruments during shipment. The inflatable, encapsulating package liner 14 is inflated once in position within the box-like container 12 so as to securely engage an outer portion of the article 16 as the package liner expands inwardly. Outward expansion of the package liner 14 is limited by the inner walls of the box-like container 12 with which the package liner is in contact. Voids between the article 16 and the inner walls of the box-like container 12 are filled by the inwardly and outwardly expanding package liner 14 as it is inflated. Package liner 14 is preferably comprised of a flexible, gas-impervious material such as recyclable polyethylene, with Valeron a cross oriented type of polyethylene preferred because of its high resistance to tearing and puncturing. Package liner 12 may also be comprised of polypropylene, polyurethane, polyvinyl chloride (PVC) or any like material. Package liner 12 may also be anti-statically treated or may be made conductive with an appropriate conductive layer or laminate. Package liner 12 may further be provided with a moisture barrier either as a laminate or in the form of a surface coating.

The inflatable package liner 14 includes a plurality of side or lateral portions disposed between adjacent side portions of the box-like container 14 and article 16. First and second side portions 20, 22 are shown in the figure, with the remaining side portions not shown for simplicity. First side portion 20 includes outer and inner layers 20*a* and 20*b*, while the second side portion 22 similarly includes respective outer and inner layers 22*a* and 22*b*. As the package liner 14 is inflated, each of the outer layers firmly engages an inner surface of the box-like container 12, while each of the inner layers securely engages an outer surface of the article 16. Package liner 14 further includes first and second upper portions in the form of flaps 24 and 26 which are pivotally coupled to adjacent side portions of the package liner and are adapted for positioning between an upper surface of article 16 and upper flaps 18*a*-18*d* of the box-like container 12. A similar pair of lower flaps of the package liner 14 are provided between a lower surface of article 16 and the bottom of the box-like container 12 although these flaps are not shown for simplicity. The space between the outer and inner layers of the package liner 14 are adapted to receive air in inflating the package liner.

Figure 2:
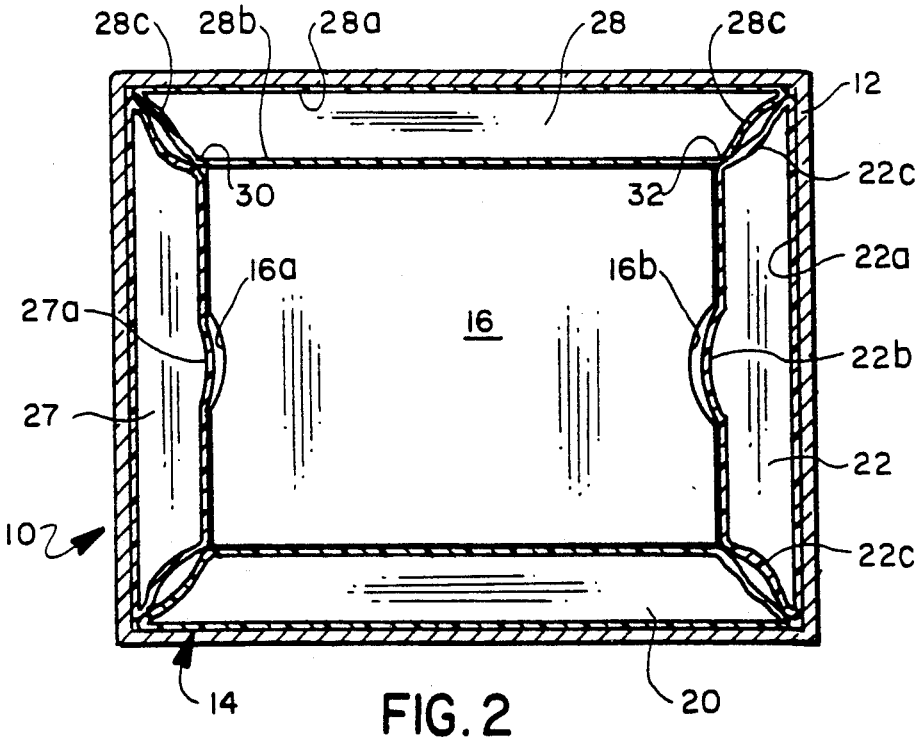
FIG. 2 is a sectional view of the packaging arrangement of FIG. 1 taken along site line 2—2 therein.

Referring to FIG. 2, there is shown a sectional view of the packaging arrangement 10 of FIG. 1 taken along site line 2—2 therein. In FIG. 2, the first and second side portions 20, 22 are shown as well as the third and fourth side portions 27 and 28. Each of the side portions includes spaced outer and inner layers as well as opposed edge portions. Thus, the fourth side portion 28 of the package liner 14 includes outer and inner layers 28*a* and 28*b* as well as a pair of opposed edge portions 28*c*. Similarly, the second side portion 22 includes the aforementioned outer and inner layers 22*a*, 22*b* as well as opposed edge portions 22*c*. One of the edge portions 28*c* of the fourth side portion 28 is positioned in close proximity to an adjacent edge portion 22*c* of the second side portion 22. Respective pairs of adjacent edge portions are shown in the figure as having a gap therebetween. This gap may be present in usage of the inflatable, encapsulating package liner 14 and allows for a certain degree of compression adjacent the edges and corners of the article 16 for providing physical shock insulation and support for the article. However, this gap may be eliminated by more completely inflating the package liner 14 for providing a more firm support and shock cushion for article 16. For explanation purposes, facing outer surfaces of article 16 are provided with respective indentations 16*a* and 16*b*. Indentations 16*a* and 16*b* represent irregularities which may be in the surface of the article 16 and are included to illustrate the manner in which the package liner 14 at least partially fills the void created by such recesses. As shown in the figure, the inner layer 27*a* of the third side portion 27 expands inwardly upon inflation to at least partially fill the void created by recess 16*a*. Similarly, the inner layer 22*b* of the second side portion 22 expands inwardly upon inflation of the package liner 14 to at least partially fill the void created by recess 16*b*. In this manner, package liner 14 is adapted to securely engage at least a portion of any surface irregularities on article 16.

End portions of the inner layers of each of the side and upper and lower portions of the package liner 14 encapsulate and securely engage the edges and corners of article 16. Thus, as shown for inner layer 28*b* of the fourth side portion 28, the end portions 30 and 32 of the inner layer extend beyond and around adjacent corners of article 16. Inflation of the fourth side portion 28 causes the end portions 30, 32 of its inner layer 28*b* to expand outwardly and extend beyond adjacent corners of article 16. The inner layer 28*b* of the fourth side portion, as well as the remaining side portions, thus engage a respective side of article 16 including its edges and corners in a generally uniform manner applying an essentially uniform inwardly directed retaining force upon the article.

Figure 3:
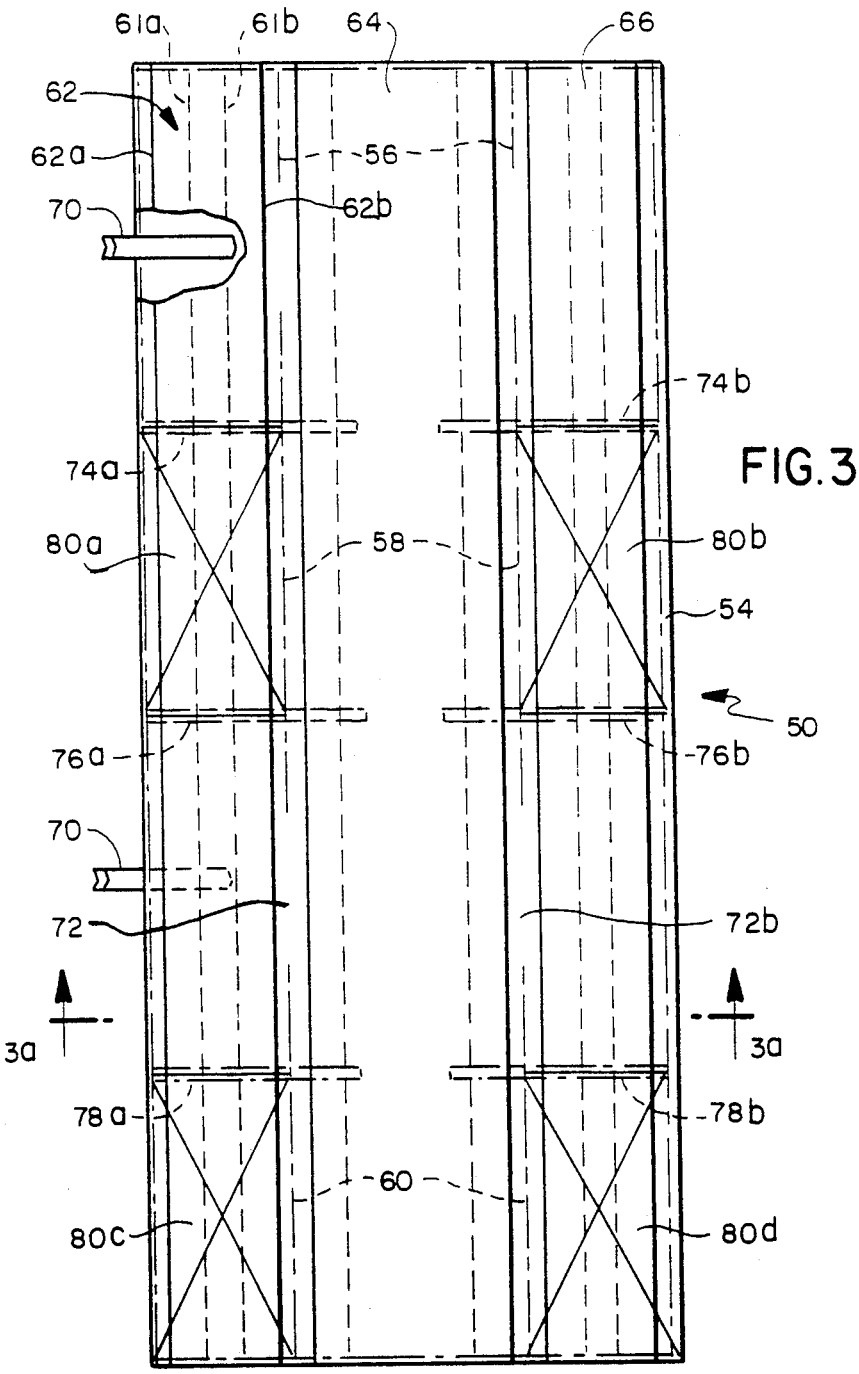
FIG. 3 is a plan view shown partially in phantom and partially cut-away of the inflatable, encapsulating package liner of FIG. 1 in a planar configuration.
Figure 3A:
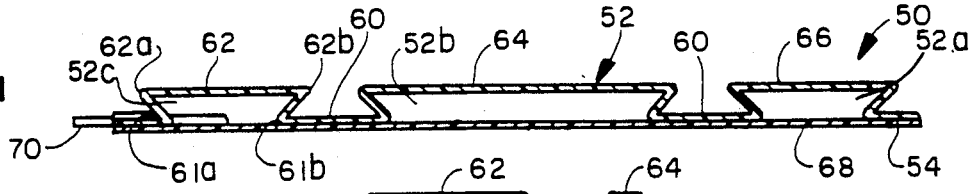
FIG. 3*a* is a sectional view of the inflatable, encapsulating package liner of FIG. 3 taken along site 3*a*—3*a* therein.
Figure 3B:
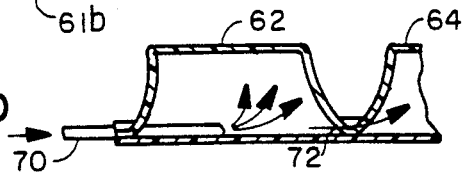
FIG. 3*b* is a sectional view of a portion of FIG. 3*a* illustrating the direction of air flow between adjacent gussetformed air chambers during inflation.

Referring to FIG. 3, there is shown a plan view of a package liner 50 such as shown disposed between article 16 and the box-like container 12 in FIG. 1. A sectional view of package liner 50 taken along site line 3*a*—3*a* in FIG. 3 is shown in FIG. 3*a*. As previously described, package liner 50 includes an inner sheet 52 and an outer sheet 68 which is disposed below the inner sheet as shown in FIG. 3*a*. A peripheral seal 54 is disposed about the peripheries of the inner sheet 52 and the outer sheet 68 to form a gas-impervious seal between the two sheets. Disposed between and sealing respective adjacent portions of inner sheet 52 and outer sheet 68 are first, second and third pairs of inner seals 56, 58 and 60. These and other seals in the package liner 50 may be formed by conventional means such as heat, pressure or radio frequency (RF) sealing means. First, second and third gussets 62, 64 and 66 are formed in a spaced manner within the inner sheet 52 and extend the length of package liner 50. Each gusset is formed by a pair of spaced outer folds and a pair of spaced inner folds. Thus, the first gusset 62 is formed of a pair of outer folds 62*a* and 62*b* as well as a pair of inner folds 61*a* and 61*b*. Each pair of adjacent outer and inner folds forms a V-shaped edge portion of the gusset allowing the gusset to expand when inflated with the outer surface of the gusset expanding generally parallel to outer sheet 68 as shown in FIG. 3*a*. A one inch tuck formed by an inner and an outer fold provides a two inch gusset, while a two inch tuck provides a four inch thick gusset. The first gusset 62 forms a first chamber 52*c* with the outer sheet 68 as shown in FIG. 3*a*. Similarly, second and third gussets 64 and 66 respectively form second and third chambers 52*b* and 52*a* with the outer sheet 68. Each of the three chambers 52*a*, 52*b* and 52*c* is adapted for inflation by directing air into a valve 70 attached to a side portion of the package liner 50. This is shown in the sectional view of FIG. 3*b*, where the direction of air directed into valve 70 is shown by the arrows with first and second gussets 62 and 64 shown partially inflated. A connecting passage 72 allowing air to flow from the first gusset 62 to the second gusset 64 during inflation is shown as element 72 in FIGS. 3 and 3*b*. Another connecting passage 72*b* shown in FIG. 3 allows air to flow from the second gusset 64 to the third gusset during inflation. Other connecting passages between adjacent gussets are shown in FIG. 3. Valve 70 may be installed in a sealed manner between adjacent portions of facing sheets by conventional heat sealing means. In another embodiment, a pair of polyethylene sections may be positioned between the inner and outer sheets and heat sealed in place leaving an unsealed passage or channel between the polyethylene sections. The passage is adapted to receive a small tube inserted therein for inflation, and self-seals following inflation after the tube is withdrawn.

Also included in package liner 50 is a first pair of spaced transverse seals 74*a* and 74*b*. Second and third pairs of transverse seals 76*a*, 76*b* and 78*a*, 78*b* are also shown in FIG. 3 dividing the inflatable chambers formed by the first and third gussets 62, 66 into four separate, isolated chambers. Each of the transverse seals as well as the three inner seals 56, 58 and 60 divide the package liner 50 into 12 foldable compartments, where the fold lines are defined by the various seals. As shown in FIG. 3, four sections of the package liner 50 identified as elements 80*a*, 80*b*, 80*c* and 80*d* are marked with "X's" and are formed by a combination of the inner and transverse seals. The four "Xed" sections 80*a*, 80*b*, 80*c* and 80*d* are formed in the package liner 50 to facilitate its manufacture and may be removed such as by cutting prior to use. Each of the four sections 80*a*, 80*b*, 80*c* and 80*d* is sealed off and not inflatable by virtue of the aforementioned seals as the inflation of these portions of the package liner 50 is not necessary to line the inner surface of a six-sided rectangular-type container. Thus, the remaining eight sections of the package liner 50 are coupled together by connecting passages to form a unitary inflatable structure for enclosing an article in lining the inner walls of a closed container. Those portions of the package liner 50 formed by the second gusset 64 are typically disposed about the lateral portions of the article, while the remaining four inflated sections of the package liner are adapted for positioning over the upper and lower surfaces of the article in a folding manner. The location of a pair of valves 70 inserted in a peripheral edge portion of package liner 50 allows the package liner to be inflated while in a folded configuration within a box-like container.

Figure 4:
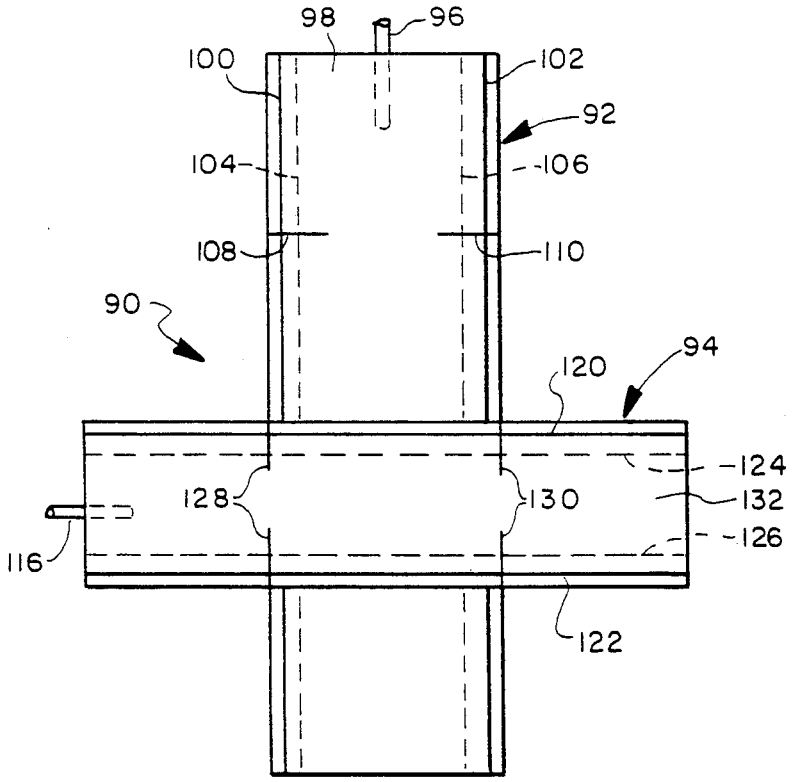
FIG. 4 is a plan view shown partially in phantom of another embodiment of an inflatable package liner in accordance with the present invention, where the inflatable package liner is shown in a planar configuration prior to installation in a closed container.
Figure 5:
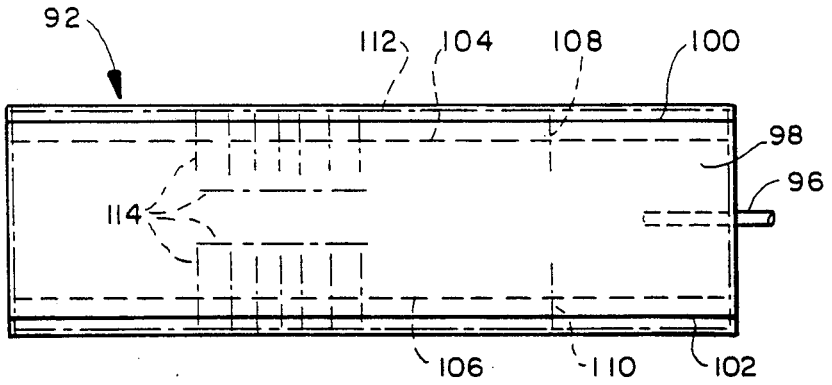
FIG. 5 is a plan view shown partially in phantom of a first section of the inflatable package liner of FIG. 4.
Figure 6:
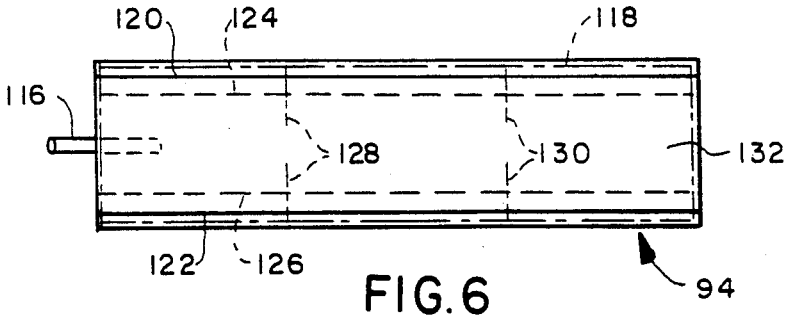
FIG. 6 is a plan view shown partially in phantom of a second section of the inflatable package liner of FIG. 4.

Referring to FIG. 4, there is shown a two-piece package liner 90 in accordance with another embodiment of the present invention. The two-piece package liner 90 includes first and second inflatable sections 92 and 94 each having a respective valve 96 and 116 therein. Planar views of the first and second package liner sections 92 and 94 partially shown in phantom are shown in FIGS. 5 and 6, respectively. The first section 92 includes a gusset 98 formed in an upper layer thereof by means of first and second outer folds 100, 102 and first and second inner folds 104, 106. Each pair of outer and inner folds forms a generally V-shaped expandable portion in the upper layer of the first section 92 allowing it to expand in a generally planar manner when inflated. A first pair of transverse seals 108, 110 extend inwardly from the lateral edges of the first section 92 and join the upper and lower layers of the package liner in a sealed manner. A plurality of rather closely spaced inner seals 114 join the upper and lower layers of the first section 9 of the package liner along the length thereof. Inner seals 114 and the pair of transverse seals 108, 110 divide the first section 92 into four foldable portions each adapted to be positioned in contact with an inner wall of a generally rectangular, closed container. Inner seals 114 permit the passage of air from the valve end of the first section 92 to the opposed end thereof to allow for inflation of the first section on both sides of the portion defined by the inner seals. The inner seals 114 prevent expansion of the adjacent portion of the first section 92 when inflated so that this portion of the package liner 90 remains thin when in position in a closed container. This avoids a double thickness portion of the package liner 90 adjacent the are of overlap of the first and second sections 92 and 94.

As shown in FIG. 6, the second section 94 of the package liner includes first and second pairs of transverse seals 128 and 130 shown in dotted-line form. A gusset 132 extending the length of the second section 94 is formed by first and second outer folds 120, 122 and first and second inner folds 124, 126 in an upper layer of the second section. The second section 94 is adapted for folding along the first and second pairs of transverse seals 128, 130, with the center portion of the second section disposed between the transverse seals positioned adjacent to the inner seals 114 of the first section 92 as shown in FIG. 4. With the first and second sections 92, 94 positioned in an overlapping manner as shown in FIG. 4, the distal ends of the second section 94 are adapted for folding upward and for engaging the side portions of an article. The portion of the first section 92 disposed between the valve end and the pair of transverse seals 108 and 110 is positioned in contact with an upper surface of an article, while the remaining two portions of the first section are adapted to engage respective side portions of the article. The location of respective valves 96 and 116 in the ends of the first and second sections 92 and 94 permits the first and second sections to be inflated while in the folded configuration within a box-like container.

The previously described embodiments of the present invention are adapted for insertion in and attachment to an inner surface of a box-like container prior to use. The box-like container may be folded prior to use as in the case of a box-like container comprised of cardboard to facilitate storage. The combination of a package liner in accordance with the present invention inserted in a folded box-like container provides a compact package for storage and facilitates handling prior to use. The package liner may be affixed to inner surfaces of the box-like container by conventional adhesives such as epoxy glue. An integrated structure comprised of the box-like container and a package liner in accordance with the present invention could be delivered for immediate use by a shipper. In preparation for use, the box-like container is folded along its fold lines, an article is placed within the container, and the package liner is then inflated to fill up the space between the article and the inner surfaces of the container. The gusseted inner surfaces of the inflatable package liner envelope the article, particularly adjacent its corners and edges, to securely maintain the article in position within the container and isolate the article from external physical shocks.

Figure 7:
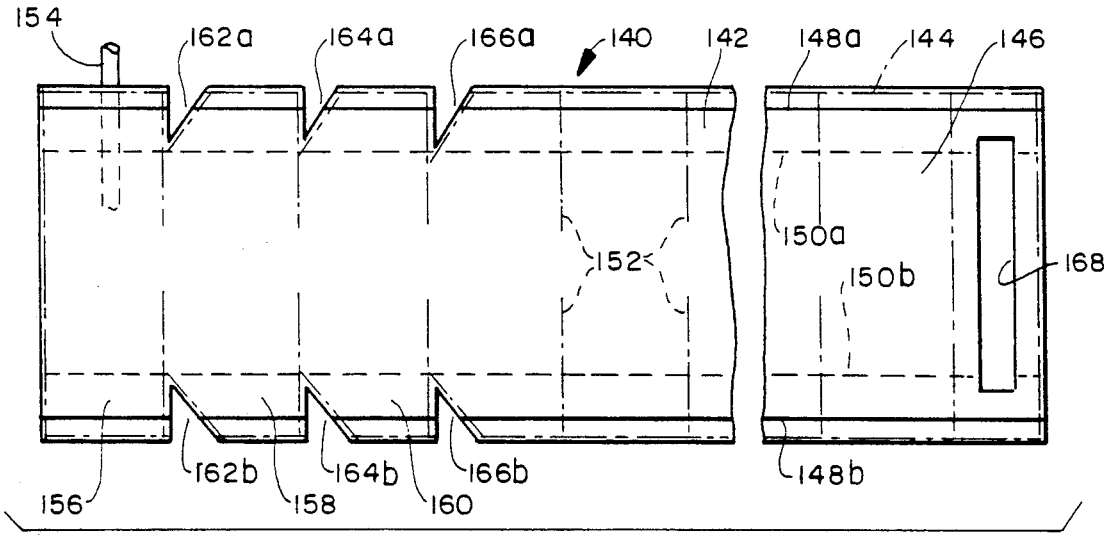
FIG. 7 is a plan view shown partially in phantom of a cinch-type inflatable package liner in accordance with yet another embodiment of the present invention.

Referring to FIG. 7, there is shown a plan view partially in phantom of a cinch-type inflatable package liner 140 in accordance with yet another embodiment of the present invention. Package liner 140 includes an inner layer 142 and an outer layer (not shown in the figure for simplicity) attached to the inner layer by means of an edge seal 140 about their respective peripheries. Inner layer 142 includes a gusset 146 formed by a pair of outer folds 148*a* and 148*b* and a pair of inner folds 150*a* and 150*b*. A plurality of transverse seals 152 are disposed in a spaced manner along the length of the package liner 140 and define separate, interconnecting, inflatable chambers. Disposed at a first end of the inflatable package liner 140 is a slot 168, while disposed adjacent a second, opposed end of the package liner is a valve 154 for inflating and deflating the package liner.

Disposed adjacent the second end of the inflatable package liner 140 are first, second and third sections 156, 158 and 160 each defined by various pairs of transverse seals. Positioned intermediate adjacent outer portions of the first and second sections 156, 158 are a first pair of notches 162*a* and 162*b*. Disposed intermediate adjacent outer portions of the second and third sections 158, 160 are a second pair of notches 164*a* and 164*b*. Finally, disposed intermediate adjacent outer portions of the third section 160 and the remaining sections of the inflatable package liner 140 is a third pair of notches 166*a* and 166*b*. The first, second and third sections 156, 158 and 160 are adapted to be inserted through slot 168 depending upon the outer peripheral dimensions of the article with which the inflatable package liner 140 is to be used. For a larger article, the first pair of notches 162*a*, 162*b* are positioned within and engage end portions of slot 168 for securely maintaining the inflatable package liner 140 in position on the article. For a smaller article, all three sections are inserted through slot 168, with the third pair of notches 166*a*, 166*b* engaging end portions of the slot to maintain the package liner securely in position on the article. After the inflatable package liner 140 is positioned about an article and is tightened so as to snugly engage the article, the package liner is then inflated to more securely engage and support the article.

Figure 8:
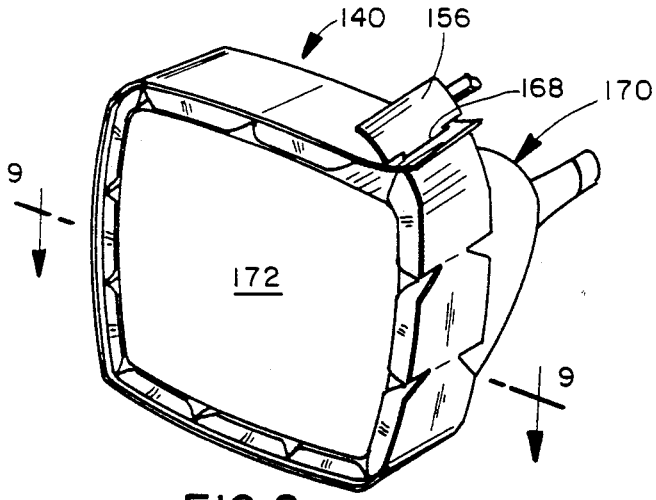
FIG. 8 is a perspective view of the cinch-type inflatable package line of FIG. 7 shown installed about a forward portion of a cathode ray tube (CRT)
Figure 9:
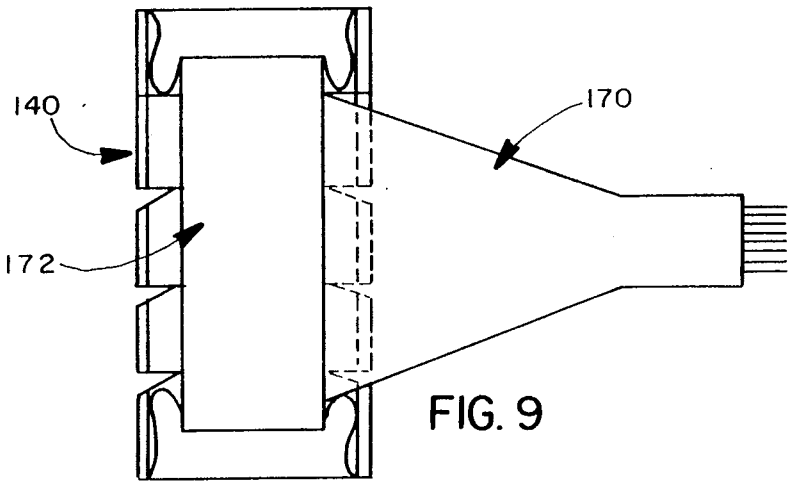
FIG. 9 is a sectional view of the inflatable package liner and CRT combination shown in FIG. 8 taken along site 9—9 therein.

FIG. 8 is a perspective view illustrating one approach for positioning the cinch-type inflatable package liner 140 about the forward periphery of a cathode ray tube (CRT) 170 adjacent its faceplate 172. FIG. 9 is a sectional view of the CRT 170 and inflatable package liner 140 shown in FIG. 8 taken along site line 9—9 therein. Package liner 140 is positioned about the forward periphery of the CRT and the first section 156 is inserted through slot 168. Package liner 140 is then inflated such that its inner layer is in tight-fitting engagement with the CRT 170. In some situations, it may be desirable to wrap two cinch-type inflatable package liners 140 about the CRT 170, where one package liner is disposed about the CRT's forward periphery as shown in the figure and another package liner is disposed about the CRT's yoke with both package liners having essentially equal outer dimensions.

Figure 10:
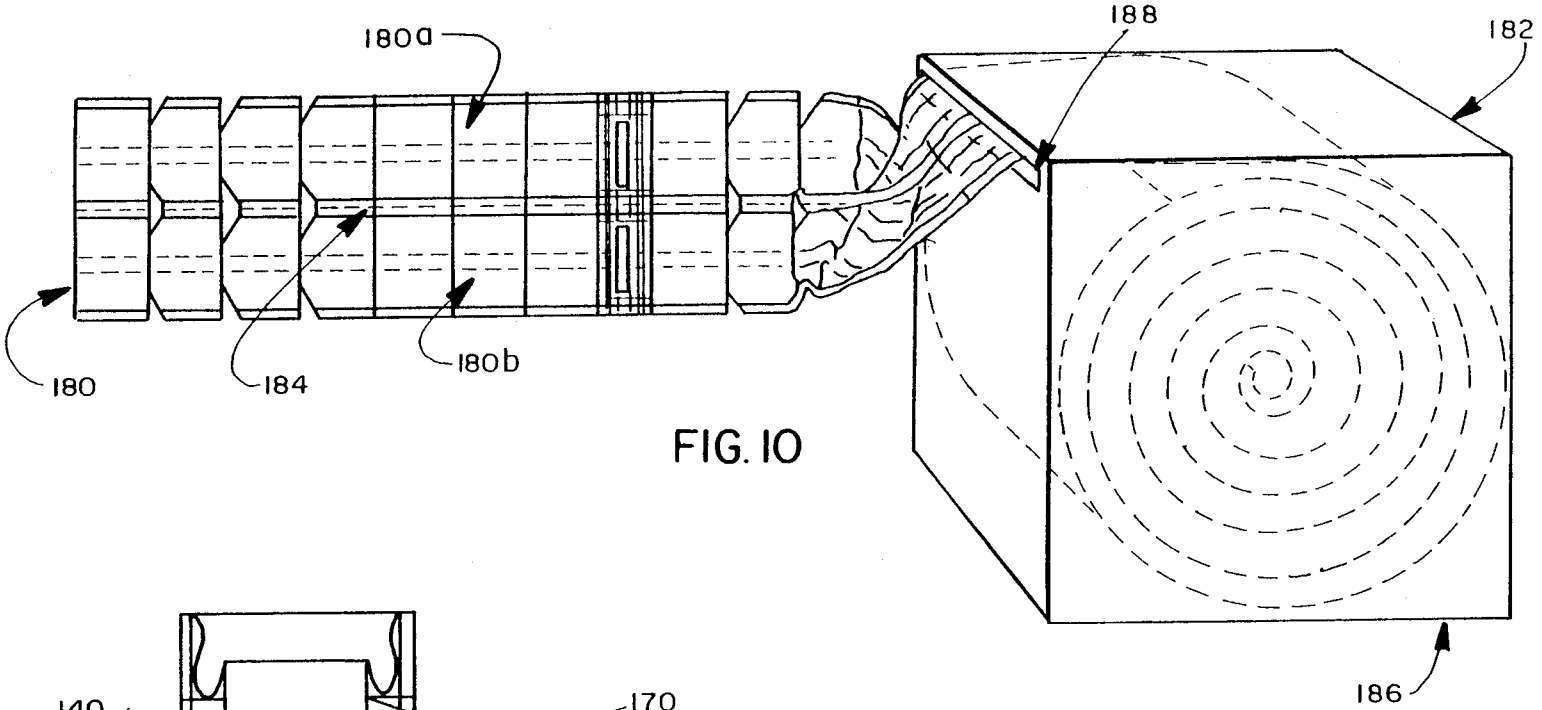
FIG. 10 is a perspective view of a cinch-type inflatable package liner and an arrangement for storing and dispensing the package liner in accordance with another embodiment of the present invention.

FIG. 10 is a perspective view of a cinch-type inflatable package liner 180 and a dispenser 182 in accordance with another aspect of the present invention. The inflatable package liner 180 includes first and second strip-like cinch-type inflatable package liners 180*a* and 180*b* joined along a line of perforations 184 which facilitates separating the two strip-like package liners depending upon the width of the package liner required. The package liner 180 is stored in a closed box-like container 186 in a rolled-up configuration as shown in dotted-line form and is withdrawn, or manually pulled from the container, via a slot 188 therein. The length of inflatable package liner 180 withdrawn from container 186 is determined by the size of the article to be wrapped, with the basic cinch-type package liner configuration repeating itself to permit virtually any length of the package liner to be withdrawn. Adjacent units of the basic inflatable package liner 180 may be separated by severing the package liner using conventional means such as a scissors along a seal between adjacent package liner sections along the length of the package liner roll.

While particular embodiments of the present invention have been shown and described, it will be obvious to those skilled in the art that changes and modifications may be made without departing from the invention in its broader aspects. For example, while the present invention has been described as disposed about an article for shipment, it may equally as well be inserted in an article such as an appliance and then inflated for protecting components of the appliance during shipping. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. An inflatable packaging insert for protecting an article within an enclosed container, said packaging insert comprising:

a first outer sheet and a second inner sheet each comprised of a flexible, gas-impervious material, wherein said first outer sheet is for contacting an inner surface of the container and said second inner sheet is for disposition about and contact with the article;

sealing means for coupling said first and second sheets in a sealed manner to form a plurality of interconnected inflatable chambers; and valve means for inflating said packaging insert, wherein said second inner sheet comprises gusset means for connecting said second inner sheet to said first outer sheet and for allowing said second inner sheet to uniformly and linearly move away from said first outer sheet during inflation of the packaging insert whereby said second inner sheet securely engages and encapsulates corners and edges of the article in a generally uniform manner.

2. The packaging insert of claim 1 wherein said flexible, gas-impervious material is polypropylene, polyethylene, polyurethane, or polyvinyl chloride (PVC).

3. The packaging insert of claim 1 wherein said sealing means comprises a heat, pressure or radio frequency (RF) formed seal.

4. The packaging insert of claim 1 wherein said valve means includes at least one hollow tube inserted intermediate said inner and outer sheets adjacent respective edges thereof in a sealed manner.

5. The packaging insert of claim 4 wherein said valve means further includes facing sheets in partially sealed contact with a channel therebetween adapted to receive and allow withdrawal of said hollow tube while remaining sealed following inflation of the packaging insert.

6. The packaging insert of claim 1 wherein said gusset means is formed by first and second pairs of inner and outer folds extending substantially the length of the packaging insert.

7. The packaging insert of claim 6 wherein said sealing means includes a plurality of spaced seals coupling said first and second sheets and forming a plurality of interconnected inflatable chambers along the length of the packaging insert and facilitating folding of the packaging insert into a plurality of sections along the length thereof.

8. The packaging insert of claim 7 wherein said gusset means includes a plurality of gussets spaced along the width of the packaging insert and extending substantially the length thereof, and wherein said gussets facilitate engagement of the second inner sheet with the top, bottom and sides of an article and the edges and corners therebetween.

9. The packaging insert of claim 1 further comprising adhesive means disposed on said first outer sheet for attaching the packaging insert to inner surfaces of the container prior to use.

10. The packaging insert of claim 9 wherein the container and packaging insert each include respective pluralities of fold lines for allowing the container and packaging insert combination to be folded to a compact size when not in use.

11. The packaging insert of claim 1 further comprising an anti-static layer.

12. The packaging insert of claim 1 further comprising an electrically conductive layer.

13. The packaging insert of claim 1 further comprising a moisture barrier.

14. A shipping container for an article, said shipping container comprising:

an outer generally rectangular closed box of cardboard or the like, wherein the article is disposed in said box;

an insert disposed within said box and about the article, said insert comprised of a pliable, gas-impervious material and including an inner layer engaging the article, an outer layer engaging an inner portion of said box, and a plurality of interconnected inflatable chambers disposed intermediate said inner and outer layers, wherein said inner layer comprises expandable gusset portions for connecting said inner layer to said outer layer and for facilitating engagement of the inner layer with the article; and valve means for inflating and deflating said insert, wherein said gusset portions allow for generally planar inward movement of said inner layer away from said outer layer during inflation of said insert to facilitate secure and generally uniform engagement of the inner layer with the sides, edges and corners of the article.

15. An inflatable packaging insert comprising:

an elongated, in flatable member having first and second facing sheets of a flexible, gas-impervious material joined together in a sealed manner to form plurality of interconnected chambers, wherein with said inflatable member disposed in a closed shipping box containing an article said first sheet engages an inner portion of said box and said second sheet engages the article;

gusset means for connecting said second sheet to said first sheet and for providing generally uniform inward displacement of said second sheet away from said first sheet upon inflation of said member; and coupling means disposed on opposed ends of said inflatable member for connecting the ends of said inflatable member together to form a sleeve-like closed member, wherein said second sheet faces inwardly for engaging lateral portions as well as corners and edges of the article by means of said uniform displacement of said second sheet.

16. The inflatable packaging insert of claim 15 further comprising a plurality of seals between said first and second sheets for forming said plurality of interconnected chambers along the length of said inflatable member in facilitating folding of the packaging insert.

17. The inflatable packaging insert of claim 15 further comprising valve means including a hollow tube inserted intermediate adjacent edge portions of said first and second sheets to permit inflation and deflation of said member.

18. The inflatable packaging insert of claim 15 wherein said elongated, inflatable member is comprised of polyethylene.

19. The inflatable packaging insert of claim 15 wherein said gusset means is formed by first and second spaced pairs of inner and outer folds extending substantially the length of the packaging insert.

20. The inflatable packaging insert of claim 15 wherein said coupling means includes a slot in a first end of said inflatable member and a plurality of spaced notches adjacent a second opposed end of said inflatable member, and wherein said notches adapted for engaging end portions of said slot.

21. The inflatable packaging insert of claim 20 wherein said notches are arranged in pairs with each notch disposed on an opposed edge of said inflatable member.

22. The inflatable packaging insert of claim 21 wherein each pair of notches defines a section of said inflatable member with said sections adapted for insertion through said slot such that a respective pair of notches engages said slot and the number of sections inserted through said slot determines the length of said inflatable member disposed about an article.

23. The inflatable packaging insert of claim 15 including a plurality of elongated, inflatable members coupled together along the length thereof, wherein adjacent members are coupled by means of a line of perforations to facilitate separation of adjacent members.

24. The inflatable packaging insert of claim 23 wherein each of said coupled elongated, inflatable members includes a plurality of coupling means disposed in a spaced manner along the respective lengths thereof so as to form a plurality of connected inflatable members along the inflatable packaging insert.

25. The inflatable packaging insert of claim 24 further comprising dispensing means for dispensing a selected length of the inflatable packaging insert in accordance with the size of the article.

26. The inflatable packaging insert of claim 25 wherein said dispensing means includes a generally closed box-like structure within which the inflatable packaging insert is arranged in a rolled-up configuration, said box-like structure having a slot-like aperture therein to permit withdrawal of the inflatable packaging insert therefrom.

27. The inflatable packaging insert of claim 15 further comprising an anti-static layer.

28. The inflatable packaging insert of claim 15 further comprising an electrically conductive layer.

29. The inflatable packaging insert of claim 15 further comprising a moisture barrier.

* * * * *

UNITED STATES PATENT AND TRADEMARK OFFICE

CERTIFICATE OF CORRECTION

PATENT NO. : 5,180,060

DATED : January 19, 1993

INVENTOR(S) : Ernesto R. Forti & Judith A. Jarvis

It is certified that error appears in the above-identified patent and that said Letters Patent is hereby corrected as shown below:

| COLUMN | LINE | DESCRIPTION |
|---|---|---|
| 3 | 16 | Insert a hyphen between "gusset" and "formed" |
| 6 | 55 | "9" should be --92-- |
| 7 | 1 | "are" should be --area-- |
| IN THE CLAIMS: | | |
| 10 | 41 | "in flatable" should be one word |
| 10 | 43 | After "form", insert --a-- |

Signed and Sealed this

Twenty-sixth Day of October, 1993

Bruce Lehman

*Attest:*

BRUCE LEHMAN

*Attesting Officer*

*Commissioner of Patents and Trademarks*